US007513266B2

(12) United States Patent
Hayashi

(10) Patent No.: US 7,513,266 B2
(45) Date of Patent: Apr. 7, 2009

(54) COLLAPSIBLE UMBRELLA

(75) Inventor: Hidenobu Hayashi, Tokyo (JP)

(73) Assignee: Shibuya Ryutsu Co., Ltd., Tokyo (JP)

( * ) Notice: Subject to any disclaimer, the term of this patent is extended or adjusted under 35 U.S.C. 154(b) by 142 days.

(21) Appl. No.: 10/581,058

(22) PCT Filed: May 26, 2005

(86) PCT No.: PCT/JP2005/009682

§ 371 (c)(1),
(2), (4) Date: May 30, 2006

(87) PCT Pub. No.: WO2005/120282

PCT Pub. Date: Dec. 22, 2005

(65) Prior Publication Data

US 2007/0107759 A1 May 17, 2007

(30) Foreign Application Priority Data

Jun. 9, 2004 (JP) ..... 2004-171473

(51) Int. Cl.
*A45B 25/06* (2006.01)
*A45B 19/00* (2006.01)

(52) U.S. Cl. ..... 135/28; 135/31; 135/25.1

(58) Field of Classification Search ..... 135/15.1, 135/25.1, 25.3, 25.4, 25.41, 31
See application file for complete search history.

(56) References Cited

U.S. PATENT DOCUMENTS 4,607,653 A * 8/1986 Hermanson ..... 135/20.3
5,135,016 A * 8/1992 Stiller ..... 135/25.3
5,615,697 A * 4/1997 Lin et al. ..... 135/20.1
5,855,220 A 1/1999 Wu
2003/0102020 A1* 6/2003 Lin et al. ..... 135/15.1

FOREIGN PATENT DOCUMENTS

DE 296 22 206 2/1997

(Continued)

OTHER PUBLICATIONS

Supplementary European Search Report for European Application No. 05 74 3711.3-2313 dated Jul. 11, 2008.

*Primary Examiner*—David Dunn
*Assistant Examiner*—Danielle Jackson
(74) *Attorney, Agent, or Firm*—Wenderoth, Lind & Ponack, L.L.P.

(57) ABSTRACT

First longitudinal grooves are formed in the lateral sides of wing parts of a cap and a slider. First through holes are formed to intersect the first longitudinal grooves in the cap and the slider. Second through holes are formed in positions closer to the centers of the cap and the slider than the first through holes. In the cap, two ribs pointing in the lateral directions are individually supported to be pivotable at the first longitudinal grooves by supporting members in the first through holes, and other ribs are pivotally supported in a collective manner by a circular supporting wire passing through the second through holes. In the slider, two stretchers pointing in the lateral directions are individually supported to be pivotable at the first longitudinal grooves by supporting members in the first through holes, and other stretchers are pivotally supported in a collective manner by a circular supporting wire passing through the second through holes.

2 Claims, 6 Drawing Sheets

FOREIGN PATENT DOCUMENTS

| | | |
|---|---|---|
| JP | 58-26319 | 2/1983 |
| JP | 59-22508 | 2/1984 |
| JP | 2-41107 | 2/1990 |
| JP | 5-48712 | 6/1993 |
| JP | 6-34505 | 5/1994 |
| JP | 10-14630 | 1/1998 |
| JP | 10-28606 | 2/1998 |
| JP | 3058866 | 3/1999 |

* cited by examiner (a)

(b)

COLLAPSIBLE UMBRELLA

BACKGROUND OF THE INVENTION

1. Field of the Invention

The present invention relates to a collapsible umbrella that can be folded into a flat shape. More specifically, the present invention relates to a collapsible umbrella that is effective when applied to three section umbrellas.

2. Description of the Related Art

FIG. 5 and FIGS. 6*a* to 6*d* show configuration examples of a conventional three section umbrella. As shown in FIG. 5, a collapsible umbrella of this type includes a cap 21' fixed to the upper portion of a telescopic shaft 10', collapsible ribs 40' which are pivotally supported by the cap 21', a slider 22' which is slidably guided along the shaft 10' below the cap 21', and stretchers 44 which are pivotally supported by the slider 22' and support the ribs 40'. When a canopy is opened, the ribs 40' and the stretchers 44 are radially stretched and separated. Meanwhile, when the canopy is closed, the ribs 40' are folded and are tied in a bundle with the stretchers 44, so that they are substantially in parallel with the shaft 10'.

The shaft 10' is a telescopic shaft composed of a series of telescopic pipes. A ferrule 11 and a handhold 12 are attached to the front end (upper end) and the basal end (lower end) of the shaft 10', respectively. Further, the shaft 10' is provided with a latch 13 for releasably locking the slider 22' at the intermediate portion near the front end (upper end) thereof.

Each of the ribs 40' is formed of three foldable sections consisting of a top rib 41 (also referred to as long rib), an intermediate rib 42 and a tail rib 43. A supporting rib 45 (also referred to as back rod) is connected to each stretcher 44. Together with the top ribs 41 and the intermediate ribs 42, the supporting ribs 45 create a link mechanism by which the ribs 40' are bent and stretched in conjunction with up-and-down movement of the slider 22'.

Wire springs 47 (also referred to as spring line) are provided to bridge between the top ribs 41 and the tail ribs 43. The intermediate portions of the wire springs 47 are locked to the intermediate portions of the intermediate ribs 42 so as to be movable, thus providing a spring action (spring function) to the ribs 40' for bend and stretch movement.

The top ribs 41 and the intermediate ribs 42 are constructed from a metal member (e.g., steel or aluminum alloy) having a U-shaped cross section. As partially shown in FIG. 5 in closeup, the portion where the wire spring 47 is locked to the intermediate rib 42 so as to be movable is formed by bending an extending part 421, formed integrally with the intermediate rib 42.

Note that, in FIG. 5, reference numeral 51 denotes a protruding part or an extending part, each of which is referred to as a dowel and provided to form a joint that is rotationally movable.

FIGS. 6*a* and 6*b* respectively show the principal portions of the cap 21' and the slider 22'. The cap 21' and the slider 22' are formed of cylindrical bosses having at their centers shaft guide holes 51*a* and 51*b*, respectively. The cap 21' and the slider 22' are respectively provided with longitudinal grooves 52*a* and 52*b*, which are pointing in directions radial to the shaft 10 at regular intervals (pointing in directions separated by 60° in the illustrative examples).

FIG. 6*c* shows the relative positions of a cap, a slider, ribs and stretchers of a conventional collapsible umbrella when a canopy is opened, and FIG. 6*d* shows the same when the canopy is closed. As shown in FIGS. 6*c* and 6*d*, the cap 21' and the slider 22' are provided with circular supporting wires (one turn wires) 54, going round the cap 21' and the slider 22' while passing through the longitudinal grooves 52*a* and 52*b*, respectively. The circular supporting wires 54 form a common spindle for pivotally supporting the top ribs 41 and the stretchers 44 to the longitudinal grooves 52*a* and 52*b* in a collective manner. Thus, as shown in FIG. 6*c*, the ribs 41 and the stretchers 44 are radially stretched and separated when the canopy is opened. Meanwhile, as shown in FIG. 6*d*, the top ribs 41 and the stretchers 44 are tied together in a bundle and are placed in a circle around the cap 21' and the slider 22' when the canopy is closed. In this case, although not shown, the three section ribs 40 are tied together in a bundle around the cap 21' and the slider 22', with the top ribs 41, the intermediate ribs 42 and the tail ribs 43 folded up.

The entirety or part of the above-described configuration of a collapsible umbrella is described, for example, in the following patent documents 1 to 5:

[Patent Document 1] Japanese Patent Laid-Open No. H09-51811

[Patent Document 2] Japanese Utility Model No. 3070862

[Patent Document 3] Japanese Patent Laid-Open No. H09-84617

[Patent Document 4] Japanese Patent Laid-Open No. H09-51811

[Patent Document 5] Japanese Patent Laid-Open No. H08-80207

As described previously, in a conventional collapsible umbrella, the ribs 40' and the stretchers 44 are tied together in a bundle and are placed in a circle around the cap 21' and the slider 22' when the umbrella is folded up. In addition, the ribs 40' are tied together in a bundle, with the top ribs 41, the intermediate ribs 42 and the tail ribs 44 folded up. Along with this, an umbrella canvas (not shown) is folded around the cap 21' and the slider 22' together with the ribs 40'.

For this reason, the umbrella has a cylindrical, thick, rounded shape when folded up as shown in FIG. 4*b*. When a collapsible umbrella having such a thick cylindrical shape is contained in a bag or the like, it may futilely create a thick spacing in the bag, cause an awkward bulging, and generate local compression on items in the bag. Furthermore, there has been inconvenience that such a collapsible umbrella cannot be contained in cases with a small thickness.

In this connection, the present inventor has focused on the fact that it is particularly effective to flatten the shape of a folded umbrella in order to increase convenience of housing and carrying of collapsible umbrellas, rather than miniaturizing the entire shape of a folded umbrella. The present inventor has also established that the miniaturization of the entire shape of a folded umbrella would entail reduction in the umbrella function, like reduction in the open size of an umbrella, which resulted in little improvement in the capability of housing of collapsible umbrellas in a bag or the like.

However, a collapsible umbrella having the conventional structure described above is folded in such a way that the ribs 40' and the stretchers 44 are tied together in a bundle and are placed in a circle around the cap 21' and the slider 22'. Accordingly, such a collapsible umbrella is forced to have a thick, cylindrical shape when folded up.

SUMMARY OF THE INVENTION

The present invention has been accomplished in view of the foregoing problems, and an object thereof is to provide a collapsible umbrella wherein, for example, the shape of the folded umbrella can be flattened without impairing umbrella function such as open size of the collapsible umbrella. The flattening is effective in increasing convenience of housing and carrying of collapsible umbrellas and also can allow the collapsible umbrella to be housed in a chest pocket or the like without causing an awkward bulging.

The means according to the present invention is a collapsible umbrella which is characterized by comprising the following means (1):

(1) A collapsible umbrella which includes: a cap fixed to the upper portion of a telescopic shaft; collapsible ribs which are pivotally supported by the cap; a slider which is slidably guided along the shaft below the cap; and stretchers which are pivotally supported by the slider and support the ribs, the ribs and the stretchers being radially stretched and separated when a canopy is opened, the ribs being folded and tied in a bundle with the stretchers in a way that they are substantially in parallel with the shaft when the canopy is closed, wherein wing parts are formed in the cap and the slider, the wing parts protruding in the lateral directions from the middle portions between the front and back surfaces of flat blocks, first longitudinal grooves are formed in the lateral sides of the wing parts, first through holes are formed so as to intersect the first longitudinal grooves formed in the cap and the slider, second through holes are formed in positions closer to the centers of the cap and the slider than the first through holes, in the cap, two of the ribs, pointing in the lateral directions, are individually supported so as to be pivotable at the first longitudinal grooves by means of supporting members provided in the first through holes and other ribs are pivotally supported in a collective manner by a circular supporting wire passing through the second through holes, and in the slider, two of the stretchers, pointing in the lateral directions, are individually supported so as to be pivotable at the first longitudinal grooves by means of supporting members provided in the first through holes and other stretchers are pivotally supported in a collective manner by a circular supporting wire passing through the second through holes.

In the above means, the addition or combination of the means described below is particularly effective.

(2) The collapsible umbrella as set forth in item (1), wherein second grooves, which are relatively shallow, are formed between the wing parts and the front and back surfaces of the flat blocks of the cap and the slider, the basal ends of the other ribs are placed in the second longitudinal grooves of the cap, the basal ends of the other stretchers are placed in the second grooves of the slider, and the second through holes are formed in the vicinities of the second grooves of the cap and the slider.

(3) The collapsible umbrella as set forth in any one of items (1) and (2), wherein the shaft is formed to have a flat cross section, and the cap and the slider through which the shaft passes are formed to have flat rectangular shapes that are horizontally oriented.

(4) The collapsible umbrella, wherein a handhold, which receives the front ends of tail ribs in a state where the ribs are folded up, is formed to have a rectangular, dish-like shape that is horizontally oriented.

(5) The collapsible umbrella, wherein three section ribs are used, each having a top rib, an intermediate rib and a tail rib, and wire springs are provided to bridge between the top ribs and the tail ribs, the intermediate portions of the wire springs are locked to the intermediate portions of the intermediate ribs so as to be movable, and thus a spring action is provided to the ribs for bend and stretch movement, and wherein loops are formed in the intermediate portions of the wire springs in a way that the intermediate ribs draw therethrough, thus locking the intermediate portions of the wire springs to the intermediate portions of the intermediate ribs so as to be movable.

(6) The collapsible umbrella as set forth in any one of items (1) to (5), wherein supporting ribs, which form a link mechanism by which the ribs are bent and stretched in conjunction with up-and-down movement of the slider, are constructed from wire rods, and these supporting ribs having wire-like shapes and the top ribs are connected together via dowel members so as to be rotationally movable.

It is made possible to provide a collapsible umbrella wherein, for example, the shape of the folded umbrella can be flattened without impairing umbrella function such as open size of the collapsible umbrella. The flattening is effective in increasing convenience of housing and carrying of collapsible umbrellas and also can allow the collapsible umbrella to be housed in a chest pocket or the like without causing an awkward bulging.

Features and objects of the present invention other than the above will become clear by reading the description of the present specification with reference to the accompanying drawings.

BRIEF DESCRIPTION OF THE DRAWINGS

For amore complete understanding of the present invention and the advantages thereof, reference is now made to the following description taken in conjunction with the accompanying drawings wherein.

DETAILED DESCRIPTION OF THE INVENTION

At least the following matters will be made clear by the explanation in the present specification and the description of the accompanying drawings.

Figure 1:
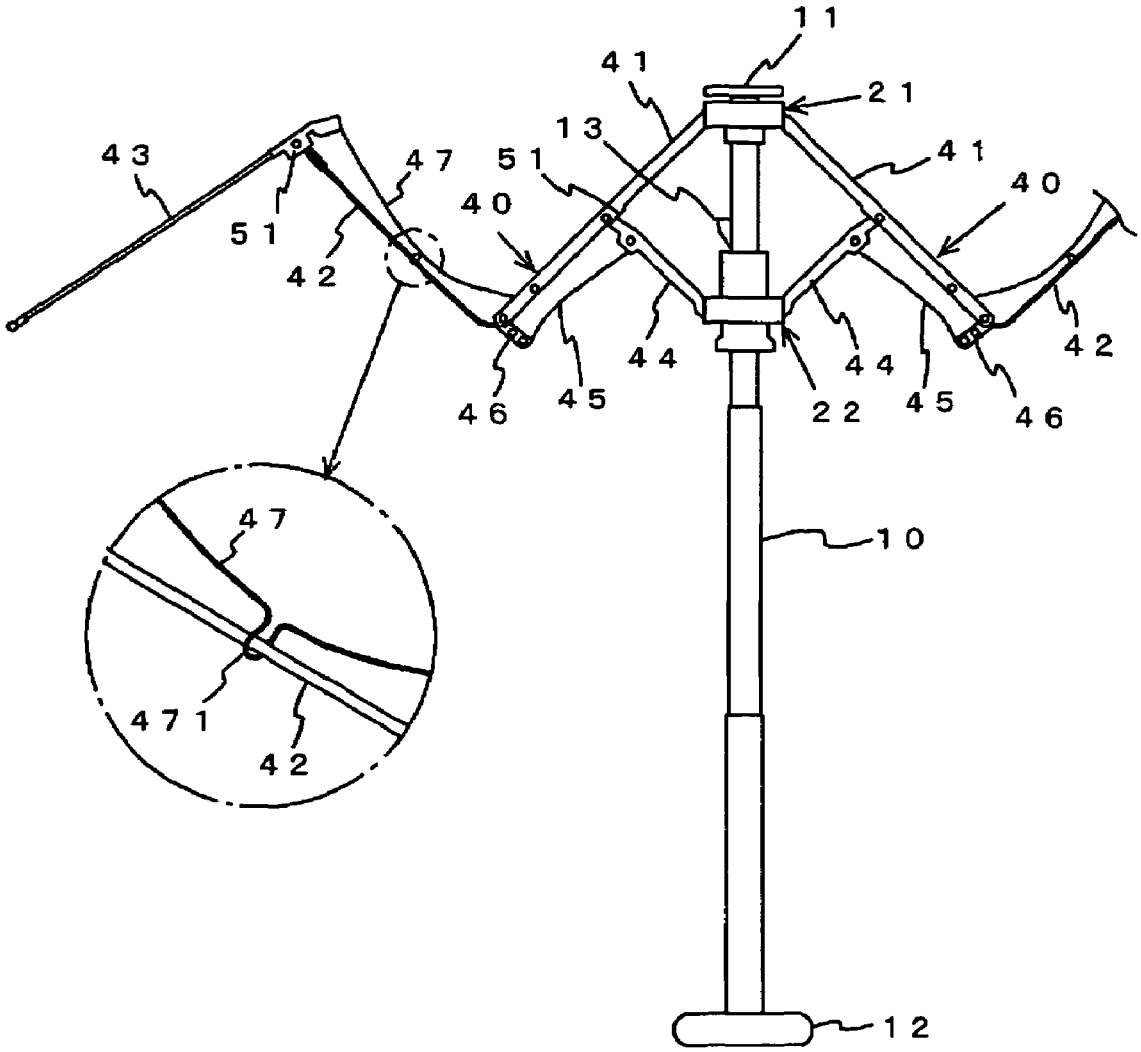
FIG. 1 is an abbreviated side view, and a partially enlarged perspective view of the frame structure of a collapsible umbrella according to the present invention.
Figure 2:
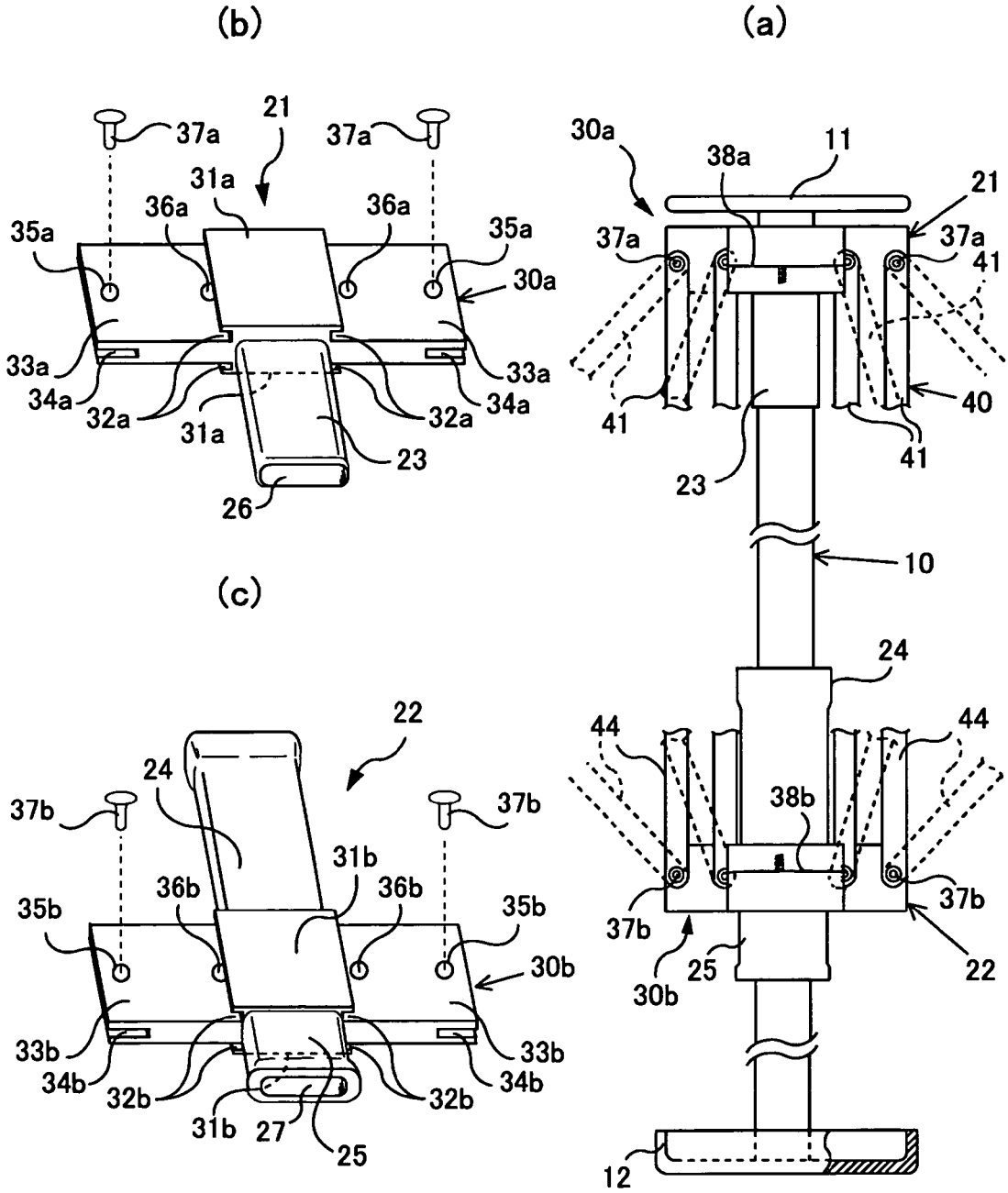
FIG. 2*a* is a side view showing the principal portions of a cap and a slider of the collapsible umbrella according to the present invention.
FIG. 2*b* is a perspective view of the cap.
FIG. 2*c* is a perspective view of the slider.

FIG. 1 shows the frame structure of a collapsible umbrella constituting one embodiment of the present invention, and FIGS. 2*a* to 2*c* show structures of a cap and a slider, constituting the principal portions of the present invention.

Firstly, as shown in FIGS. 1 and 2*a*, the collapsible umbrella according to the present invention includes a cap 21 fixed to the upper portion of a telescopic shaft 10, collapsible ribs 40(41) which are pivotally supported by the cap 21, a slider 22 which is slidably guided along the shaft 10 below the cap 21, and stretchers 44 which are pivotally supported by the slider 22 and support the ribs 40. When a canopy is opened, the ribs 40 and the stretchers 44 are radially stretched and separated. Meanwhile, when the canopy is closed, the ribs 40 are folded and are tied in a bundle with the stretchers 44, so that they are substantially in parallel with the shaft 10.

The shaft 10 is composed of five cylinders with different diameters, which are engaged together in a telescopic manner. A ferrule 11 and a handhold 12 are attached to the front end (upper end) and the basal end (lower end) of the shaft 10, respectively. Further, the shaft 10 is provided with a latch 13 for releasably locking the slider 22 near the front end (upper end) thereof.

Each of the ribs 40 is formed of three foldable sections consisting of a top rib 41 (also referred to as long rib), an intermediate rib 42 and a tail rib 43. A supporting rib 45 (also referred to as back rod) is connected to each stretcher 44. Together with the top ribs 41 and the intermediate ribs 42, the supporting ribs 45 create a link mechanism by which the ribs 40 are bent and stretched in conjunction with up-and-down movement of the slider 22.

Wire springs 47 (also referred to as spring line) are provided to bridge between the top ribs 41 and the tail ribs 43. The intermediate portions of the wire springs 47 are locked to the intermediate portions of the intermediate ribs 42 so as to be movable, thus providing a spring action (spring function) to the ribs 40 for bend and stretch movement.

The top ribs 41 are constructed from a metal member (e.g., steel or aluminum alloy) having a U-shaped cross section. However, the intermediate ribs 42 are constructed from a wire rod such as steel (or a thin rod such as FRP). This is because of allowing the ribs 40 to be tied in a small bundle and folded up.

As partially shown in FIG. 1 in closeup, the portion where the wire spring 47 is movably locked to the intermediate rib 42 is formed by forming a loop 471 in the intermediate portion of the wire spring 47 so that the intermediate rib 42 draws therethrough. By this, it is made possible to lock the intermediate portions of the wire spring 47 to the intermediate portions of the intermediate ribs 42 so as to be movable without providing the intermediate ribs 42 with locking portions and without requiring extra locking components.

In the illustrative embodiment, the supporting ribs 45, which form a link mechanism by which the ribs 40 are bent and stretched in conjunction with up-and-down movement of the slider 22, are constructed from wire rods. In addition, these wire-like supporting ribs 45 and the top ribs 41 are connected together via dowels 46 so as to be rotationally movable. In this way the ribs 40 can be tied in a smaller bundle and folded up.

Note that, in this drawing, reference numeral 51 denotes a protruding part or an extending part, each of which is referred to as a dowel and provided to form a joint that is rotationally movable.

As shown in FIG. 2*a*, the cap 21 is provided with a boss 30*a* for pivotally supporting the ribs 40, under which a sleeve 23 is integrally formed. Furthermore, the slider 22 is provided with a boss 30*b* for pivotally supporting the stretchers 44 above which a sleeve 24 is integrally formed. The sleeves 23 and 24 are formed in such a way that the sleeve 24 slides up the shaft 10 and fits into the sleeve 23 when the slider 22 is pushed in the position where it is held by the latch 13 (See FIG. 1). At the lower position of the slider 22, a grip sleeve 25 is integrally formed for the moving operation of the slider 22. The lower end of the grip sleeve 25 is configured to be held by the latch 13.

As shown in the perspective view of FIG. 2*b*, the boss 30*a* in the cap 21 includes flat, rectangular wing parts 33*a* and 33*a* which laterally protrude from the middle positions of the front and back surfaces 31*a* and 31*a* of a block having a substantially flat, rectangular shape. First longitudinal grooves 34*a* and 34*a*, which are deep grooves, are formed in the lateral sides of the wing parts 33*a* and 33*a*. Moreover, first through holes 35*a* and 35*a*, intersecting the first longitudinal grooves, are formed in the vicinities of the front ends of the wing parts. Second longitudinal grooves 32*a* and 32*a*, which are shallow grooves, are formed between the flat, rectangular block and the wing parts protruding in the lateral directions. The wing parts are provided with second through holes 36*a* and 36*a* in the vicinities of the outsides of the second longitudinal grooves. The wing part pair 33*a* and 33*a*, the first longitudinal groove pair 34*a* and 34*a*, the second longitudinal groove pair 32*a* and 32*a*, the first through hole pair 35*a* and 35*a* and the second through hole pair 36*a* and 36*a* are formed so that each pair is symmetrical about the longitudinal center surface of the boss 30*a*. A flat shaft guide hole 26 into which the shaft 10 is fitted is provided in the sleeve 23 provided below the boss.

As shown in the perspective view of FIG. 2*c*, a boss 30*b* in the slider 22 has similar components as those of the boss 30*a* in the cap 21, a flat, rectangular wing parts 33*b* and 33*b* which laterally protrude from the middle positions of the front and back surfaces of flat, rectangular blocks 31*b* and 31*b*, first deep, longitudinal grooves 34*b* and 34*b*, second shallow, longitudinal grooves 32*b* and 32*b*, first through holes 35*b* and 35*b* and second through holes 36*b* and 36*b*.

Moreover, shaft guide holes 27, into which the shaft 10 with flat cross sections is fitted, are formed in the centers of sleeves 24 and 25, formed integrally with the slider 22.

Figure 3:
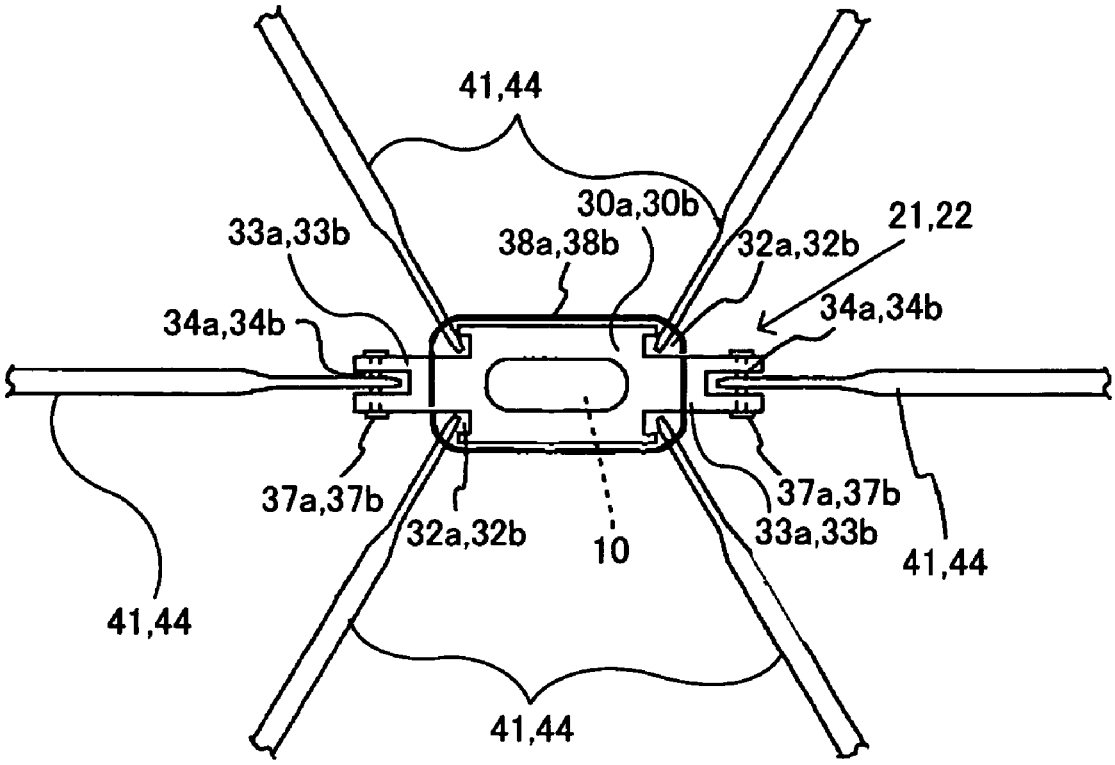
FIG. 3*a* shows the relative positions of the cap, the slider, the ribs and the stretchers of the collapsible umbrella according to the present invention in a state where a canopy is opened.
FIG. 3*b* shows the relative positions of the cap, the slider, the ribs and the stretchers of the collapsible umbrella according to the present invention in a state where the canopy is closed.
Figure 3:
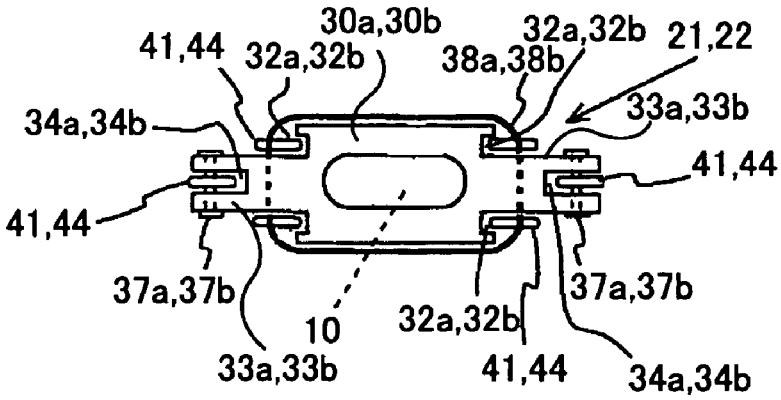

As can be seen from FIG. 3*a* which shows the relative positions of the cap 21, the slider 22, the ribs 41 and the stretchers 44 in a state where the umbrella is opened, out of the six ribs 41 of the umbrella, the upper ends of the two ribs 41 pointing in the lateral directions are fitted into the first deep, longitudinal grooves 34*a* of the boss 30*a* in the cap 21, and are pivotally supported by pins 37*a*. In addition, out of the six ribs 41 of the umbrella, the upper ends of the four ribs 41 pointing in the oblique directions are partially fitted into the second shallow, longitudinal grooves 32*a* of the boss 30*a*, and are pivotally supported by the circular supporting wire 38*a* in a collective manner. Meanwhile, out of the six stretchers 44 of the umbrella, the upper ends of the two stretchers 44 pointing in the lateral directions are fitted into the first deep, longitudinal grooves 34*b* of the boss 30*b* in the slider 22, and are pivotally supported by pins 37*b*. In addition, out of the six stretchers 44 of the umbrella, the upper ends of the four stretchers 44 pointing in the oblique directions are partially fitted into the second shallow, longitudinal grooves 32*b* of the boss 30*b*, and are pivotally supported by the circular supporting wire 38*b* in a collective manner.

With these configurations, when the canopy is opened, the ribs 40 and the stretchers 44 are radially stretched and separated while being pivotally supported by the cap 21 and the slider 22, as shown in FIG. 3*a*. Meanwhile, as shown in FIG. 3*b*, when the canopy is closed the ribs 40 are folded and are tied in a bundle with the stretchers 44, so that they are substantially in parallel with the shaft 10.

In this folded state, as shown in FIG. 3*b*, the ribs 40 and the stretchers 44 are tied in a bundle in such a manner that they are divided to either sides of the cap 21 and the slider 22. Along with this, although not shown, the top ribs 41, the intermediate ribs 42 and the tail ribs 43, constituting the ribs 40, are also tied in a bundle in such a manner that they are divided to either sides of the cap 21 and slider 22.

Figure 4:
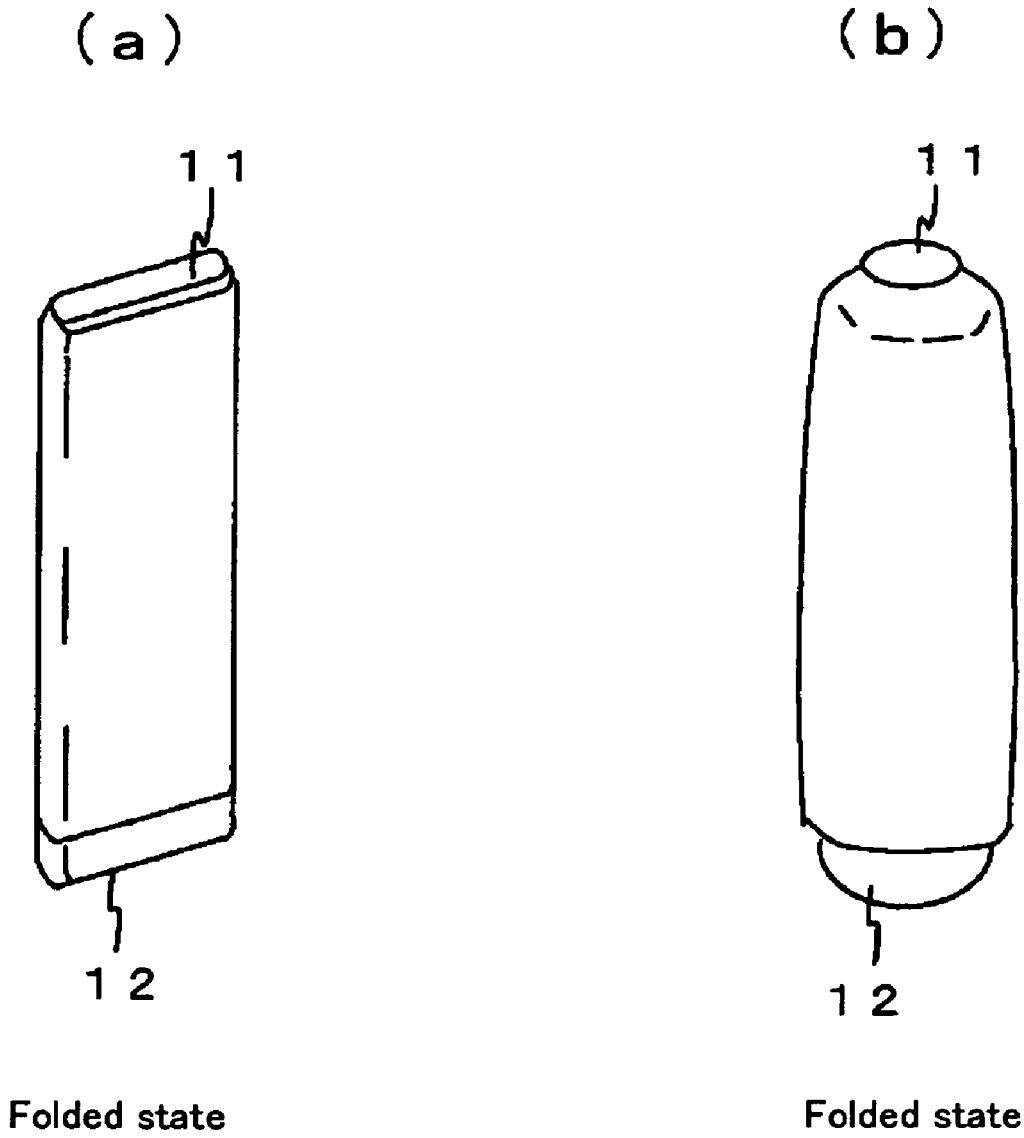
FIG. 4*a* is a perspective view showing the folded shape of the collapsible umbrella according to the present invention.
FIG. 4*b* is a perspective view showing the folded shape of a conventional collapsible umbrella.
Figure 5:
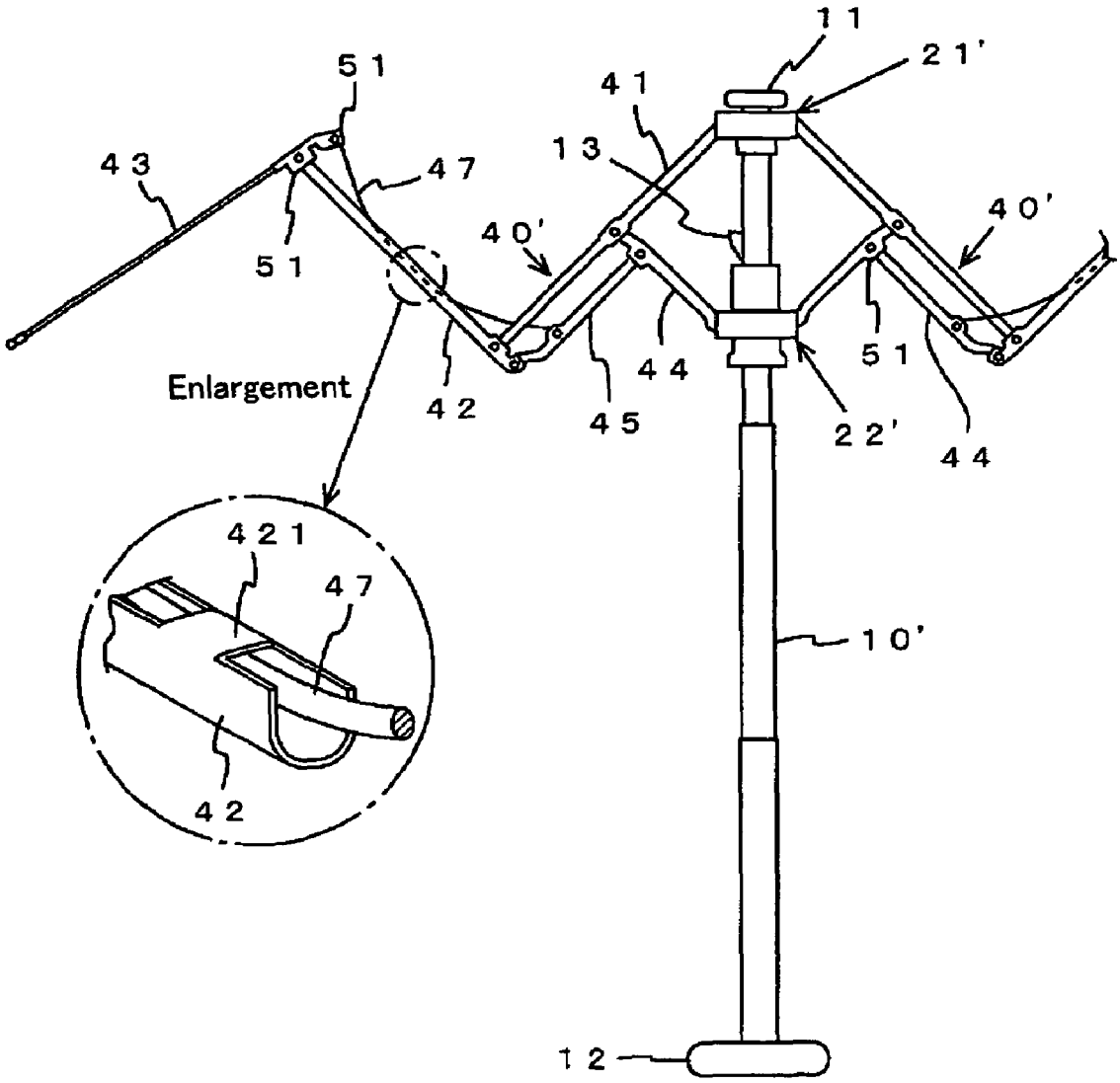
FIG. 5 is an abbreviated side view, and a partially enlarged perspective view of the frame structure of a conventional collapsible umbrella.
Figure 6:
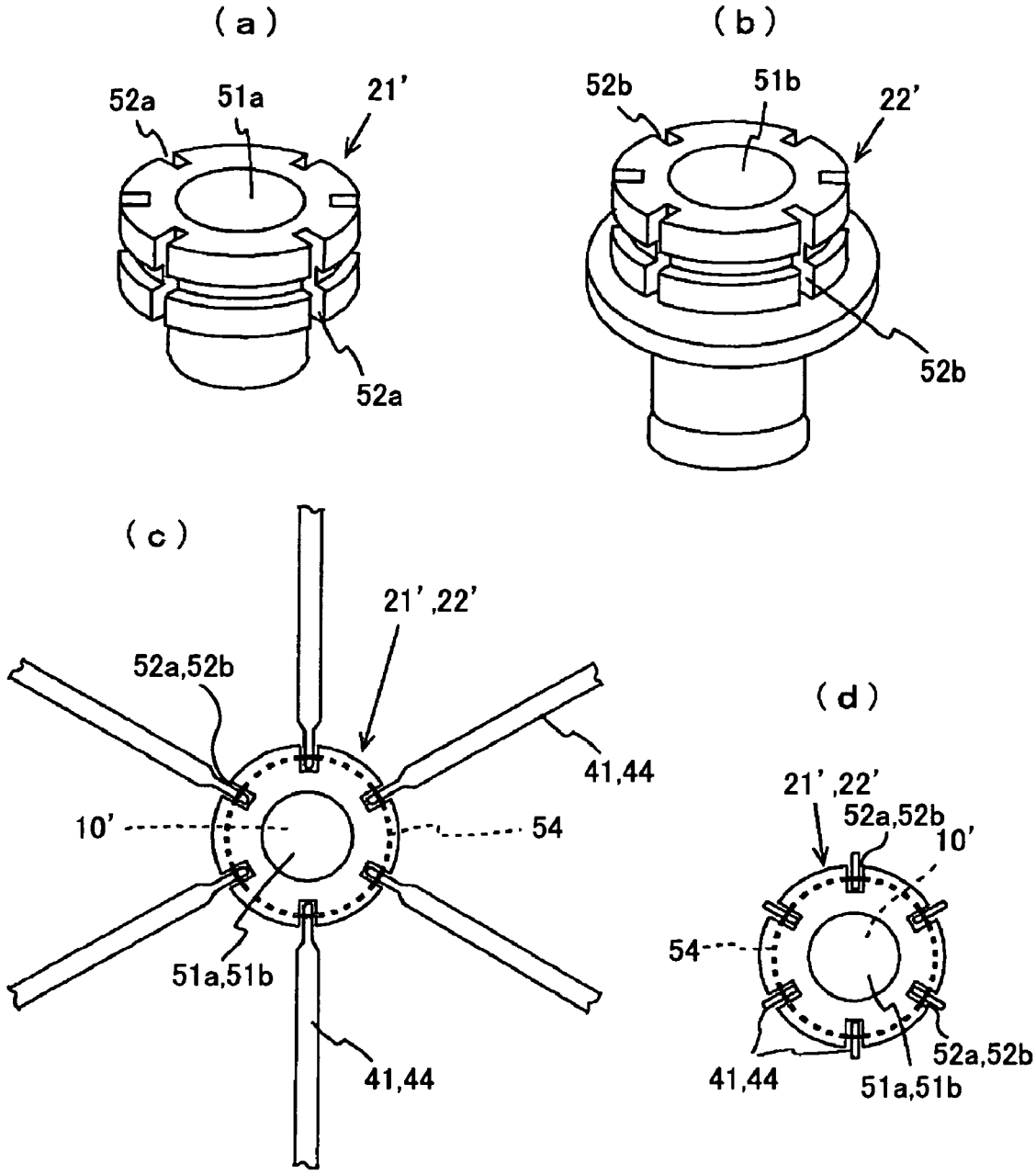
FIG. 6*a* is a perspective view showing the principal portion of a cap of the conventional collapsible umbrella.
FIG. 6*b* is a perspective view showing the principal portion of a slider of the conventional collapsible umbrella.
FIG. 6*c* shows the relative positions of the cap, the slider, the ribs and the stretchers of the conventional collapsible umbrella in a state where a canopy is opened.
FIG. 6*d* shows the relative positions of the cap, the slider, the ribs and the stretchers of the conventional collapsible umbrella in a state where the canopy is closed.

In so doing, as shown in FIG. 4*a*, an umbrella, including an umbrella canvas, is folded into a flat, thin shape in which only the width is increased, and the front ends of the tail ribs 43 are placed in a concave portion of the dish-like handhold 12 with a slender rectangular shape.

The above-described configurations are achieved as follows: that is, placing the basal ends of the two ribs and the two stretchers into the first longitudinal grooves 34*a* and 34*b*, provided at either ends of the cap 21 and the slider 22, respectively; individually supporting the two ribs and the two stretchers so as to be pivotable using the supporting members 37*a* and 37*b*; and meanwhile, supporting the other ribs and stretchers by means of a common spindle for pivotal support using the circular supporting wires 38*a* and 38*b*.

As described previously, in the present invention, the cap 21 includes: the flat, rectangular wing parts 33*a* which laterally protrude from the middle positions of the front and back surfaces 31*a* and 31*a* of the flat block; the first longitudinal grooves 34*a* and 34*a* formed in the lateral sides of the wing parts 33*a* and 33*a*; the first through holes 35*a* and 35*a* formed so as to intersect the first longitudinal grooves; and the second through holes 36*a* and 36*a* formed in positions closer to the center of the cap 21 than the first through holes, and the slider 22 includes the flat, rectangular wing parts 33*b* and 33*b* which laterally protrude from the middle position of the front and back surfaces 31*b* and 31*b* of the flat block; the first longitudinal grooves 34*b* and 34*b* formed in the lateral sides of the wing parts 33*b* and 33*b*; the first through holes 35*b* and 35*b* formed so as to intersect the first longitudinal grooves; and the second through holes 36*b* and 36*b* formed in positions closer to the center of the slider 22 than the first through holes. In the cap 21, the two ribs 41 pointing in the lateral directions are individually supported so as to be pivotable at the first longitudinal grooves by means of the supporting members 37*a* provided in the first through holes and the other ribs 41 are pivotally supported in a collective manner by the circular supporting wire 38*a* passing through the second through holes 36*a*. In the slider 22, the two stretchers pointing in the lateral directions are individually supported so as to be pivotable at the first longitudinal grooves 34*b* by means of the supporting members 37*b* provided in the first through holes 35*b*, and the other stretchers 44 are pivotally supported in a collective manner by the circular supporting wire 38*b* passing through the second through holes 36*b*. In this way the shape of a folded umbrella can be flattened, which is particularly effective in increasing convenience of housing and carrying of umbrellas, without impairing umbrella function such as open size of the umbrella. Thus, for example, a five section telescopic shaft may be adopted for the shaft 10, thereby achieving the flattening of a collapsible umbrella, which makes it possible for a collapsible umbrella to be housed in a chest pocket or the like smoothly without causing an awkward bulging.

The second shallow, longitudinal grooves 32*a* and 32*b* are respectively formed between the wing parts 33*a* and 33*b* and the front and back surfaces 31*a* and 31*b* of the flat blocks of the cap 21 and the slider 22. The basal ends of the other ribs 41 are placed in the second longitudinal grooves 32*a* of the cap 21. The basal ends of the other stretchers 44 are placed in the second groves 32*b* of the slider 22. The second through holes 36*a* and 36*b* are formed in the vicinities of the second grooves 32*a* and 32*b* of the cap 21 and the slider 22, respectively. For these reasons, when the umbrella is folded up, the basal ends of the other ribs 41 and the stretchers 44 are placed within the second longitudinal grooves 32*a* and 32*b*, facilitating flat folding of the collapsible umbrella.

Moreover, the shaft 10 is formed to have a flat cross section, and the cap 21 and the slider 22 through which the shaft 10 passes are formed to have rectangular shapes that are horizontally oriented. These are also dramatically effective in achieving further slimming of the collapsible umbrella.

Further, the three section ribs 40 are used, each of which consisting of the top rib 41, the intermediate rib 42 and the tail rib 43. In addition, the wire springs 47 are provided to bridge between the top ribs 41 and the tail ribs 43, and the intermediate portions thereof are locked to the intermediate portions of the intermediate ribs 42 so as to be movable. Accordingly, a spring action is provided to the ribs 40 for bend and stretch movement. In this three section umbrella, the loops 471 are formed in the intermediate portions of the wire springs 47 so that the intermediate ribs 42 draw therethrough. This locking structure makes it possible to reduce the diameters of the top ribs 41 and to allow the top ribs to have wire-like shapes, enabling further slimming of the folded shape of the collapsible umbrella.

Furthermore, the supporting ribs 45, which form a link mechanism by which the ribs 40 are bent and stretched in conjunction with up-and-down movement of the slider 22, are constructed from wire rods, and these wire-like supporting ribs 45 and the top ribs 41 are connected together via the dowels 46 so as to be rotationally movable. These are also dramatically effective in achieving further slimming of umbrellas.

The present invention has been described on the basis of the typical embodiment. However, the present invention can adopt various embodiments other than the one described above. For example, the ribs 40 may not be formed of three foldable sections.

It is possible to provide a collapsible umbrella wherein, for example, the shape of the folded umbrella can be flattened without impairing umbrella function such as open size of the collapsible umbrella. The flattening is effective in increasing convenience of housing and carrying of collapsible umbrellas and also can allow the collapsible umbrella to be housed in a chest pocket or the like without causing an awkward bulging.

Although the preferred embodiment of the present invention has been described in detail, it should be understood that various changes, substitutions and alterations can be made therein without departing from spirit and scope of the inventions as defined by the appended claims.

What is claimed is:

1. A collapsible umbrella comprising:

a thin cap fixed to an upper portion of a telescopic shaft;

a plurality of collapsible three sectioned ribs, each of the three sectioned ribs including a top rib, an intermediate rib and a tail rib, said top rib being pivotally supported by the cap;

a thin slider which is slidably guided along the shaft below the cap; and a plurality of stretchers which are pivotally supported by the slider and which support the three sectioned ribs, the three sectioned ribs and the stretchers being radially stretched and separated when a canopy is opened, and the three sectioned ribs being folded and tied in a bundle with the stretchers in a way that the three sectioned ribs are substantially in parallel with the shaft when the canopy is closed, wherein each of the cap and the slider include wing parts and a flat block, the wing parts protruding in lateral directions from middle portions between the front and back surfaces of the flat blocks, wherein first longitudinal U-shaped deep and narrow grooves are formed in lateral sides of the wing parts of the cap and the slider, wherein first through holes are formed so as to intersect the first longitudinal grooves formed in the cap and the slider, wherein second longitudinal U-shaped shallow and narrow grooves are formed in parallel to the first longitudinal grooves between the wing parts and the front and back surfaces of the flat blocks of the cap and the slider, wherein second through holes are formed in the vicinities of the outsides of the second longitudinal grooves, wherein the shaft is formed to have a thin rectangular shaped cross section, wherein each of the cap and the slider has a shaft guide hole formed in a thin rectangular shape through which the shaft passes, wherein a handhold, which receives free ends of the tail ribs in a state where the three sectioned ribs are folded up, is formed to have a thin rectangular shape that is horizontally oriented, wherein in the cap, two of the three sectioned ribs, pointing in the lateral directions, are individually supported so as to be pivotable at the first longitudinal grooves by means of supporting members provided in the first through holes, and other ones of the three sectioned ribs are pivotally supported in a collective manner by a circular supporting wire passing through the second through holes, and basal ends of the other ones of the three sectioned ribs are placed in the second longitudinal grooves of the cap, and wherein in the slider, two of the stretchers, pointing in the lateral directions, are individually supported so as to be pivotable at the first longitudinal grooves by means of supporting members provided in the first through holes, and other ones of the stretchers are pivotally supported in a collective manner by a circular supporting wire passing through the second through holes, and basal ends of the other ones of the stretchers are placed in the second grooves of the slider.

2. The collapsible umbrella according to claim 1, wherein the shaft is composed of five cylinders having a rectangular shape in cross section, wherein each of the five cylinders has a different diameter, and wherein the five cylinders are engaged together sequentially in a telescopic manner.

* * * * *